US007607797B2

(12) United States Patent
Walter et al.

(10) Patent No.: US 7,607,797 B2
(45) Date of Patent: Oct. 27, 2009

(54) MICROCONTROLLER-CONTROLLED MULTI-COLOR LED APPARATUS

(75) Inventors: Scott D. Walter, Twin Lakes, WI (US); Edward J. Dechant, Racine, WI (US); Scott W. Demarest, Caledonia, WI (US); Kara J. Peery (Mackey), Milwaukee, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 181 days.

(21) Appl. No.: 11/326,375

(22) Filed: Jan. 6, 2006

(65) Prior Publication Data

US 2006/0176693 A1 Aug. 10, 2006

Related U.S. Application Data

(60) Provisional application No. 60/641,441, filed on Jan. 6, 2005.

(51) Int. Cl.
*F21V 9/10* (2006.01)
*F21S 13/00* (2006.01)

(52) U.S. Cl. ..... 362/231; 362/249.02; 362/249.12

(58) Field of Classification Search ..... 362/231, 362/800, 811, 249.02, 249.12; 257/89
See application file for complete search history.

(56) References Cited

U.S. PATENT DOCUMENTS 4,992,704 A * 2/1991 Stinson ..... 315/312
5,436,535 A 7/1995 Yang et al.
5,803,579 A * 9/1998 Turnbull et al. ..... 362/231
5,836,676 A 11/1998 Ando et al.
5,924,784 A * 7/1999 Chliwnyj et al. ..... 362/234
6,285,140 B1 9/2001 Ruxton
6,411,046 B1 * 6/2002 Muthu ..... 315/309
6,459,919 B1 * 10/2002 Lys et al. ..... 362/234
6,488,390 B1 * 12/2002 Lebens et al. ..... 362/231
6,498,440 B2 * 12/2002 Stam et al. ..... 315/292
6,685,339 B2 2/2004 Daughtry et al.
6,744,223 B2 6/2004 Laflamme et al.
6,788,011 B2 * 9/2004 Mueller et al. ..... 315/292
6,801,003 B2 10/2004 Schanberger et al.
6,817,735 B2 11/2004 Shimizu et al.
6,900,471 B1 5/2005 Wicke et al.
7,014,336 B1 * 3/2006 Ducharme et al. ..... 362/231

(Continued)

FOREIGN PATENT DOCUMENTS

WO WO 01/05195 A1 1/2001

(Continued)

*Primary Examiner*—Ismael Negron

(57) ABSTRACT

Lighting object for providing a light show to an observer. The lighting object includes at least two LEDs, each of which emits light of a different wavelength, and a microcontroller for independently controlling the intensity levels of the at least two LEDs to vary colors perceived by the observer during the light show. The light show includes at least one segment for which a memory stores, for each of the at least two LEDs, a target intensity level and timing information. The microcontroller calculates a plurality of intermediate intensity levels for the at least two LEDs for the duration of the segment based on a starting intensity level, the target intensity level, and the timing information for each of the at least two LEDs. The microcontroller also controls the at least two LEDs to operate at each of the calculated intermediate intensity levels during the segment.

16 Claims, 8 Drawing Sheets

U.S. PATENT DOCUMENTS

| | | | | |
|---|---|---|---|---|
| 2001/0033488 | A1* | 10/2001 | Chliwnyj et al. | 362/231 |
| 2002/0113192 | A1 | 8/2002 | Antila | |
| 2003/0072156 | A1* | 4/2003 | Pohlert et al. | 362/231 |
| 2003/0161154 | A1 | 8/2003 | Ouyang et al. | |
| 2004/0052076 | A1 | 3/2004 | Mueller et al. | |
| 2004/0150994 | A1* | 8/2004 | Kazar et al. | 362/251 |
| 2004/0160199 | A1 | 8/2004 | Morgan et al. | |
| 2008/0129226 | A1 | 6/2008 | DeWitt et al. | |
| 2008/0130266 | A1 | 6/2008 | DeWitt et al. | |
| 2008/0130267 | A1 | 6/2008 | Dowling et al. | |

FOREIGN PATENT DOCUMENTS

| | | | |
|---|---|---|---|
| WO | WO 01/82657 | A1 | 11/2001 |
| WO | WO 03/015067 | A1 | 2/2003 |

* cited by examiner

LIGHT THEME x/y COORDINATES

| | x | y |
|---|---|---|
| RED | 0.7047 | 0.2946 |
| GREEN | 0.19 | 0.72 |
| BLUE | 0.1372 | 0.0563 |
| AUTUMN 1 | 0.1645 | 0.1549 |
| AUTUMN 2 | 0.6039 | 0.3785 |
| TUSCANY 1 | 0.6345 | 0.3538 |
| TUSCANY 2 | 0.5883 | 0.3914 |
| TUSCANY 3 | 0.6645 | 0.3291 |
| TUSCANY 4 | 0.6159 | 0.3326 |
| WINTER 1 | 0.1374 | 0.0534 |
| WINTER 2 | 0.151 | 0.1609 |
| WINTER 3 | 0.3021 | 0.1806 |
| WINTER 4 | 0.2668 | 0.1434 |
| WINTER 5 | 0.2298 | 0.2603 |

FIG. 5

```
/* Data Register, Port C */
#define    LED2      5
#define    LED1      4
#define    LED6      3

/* Data Register, Port D */
#define    LED5      6
#define    LED4      5
#define    LED3      4
#define    SWITCH    3
#define    STOP      3
#define    TXD       1
#define    RXD       0

/*****************************************************************************/
#define    XTAL          1    /* 1MHz */
#define    NOCLK         0    // 0 0 0 No clock source. (Timer/Counter stopped)
#define    SCALER1       1    // 0 0 1 clk I/O /1 (No prescaling)
#define    SCALER8       2    // 0 1 0 clk I/O /8 (From prescaler)
#define    SCALER64      3    // 0 1 1 clk I/O /64 (From prescaler)
#define    SCALER256     4    // 1 0 0 clk I/O /256 (From prescaler)
#define    SCALER1024    5    // 1 0 1 clk I/O /1024
#define    PRESCALER     SCALER8
#define    OCR1AVALUE    52631   // 50000*8=100msec for 4MHz
#define    TRUE          1
#define    FALSE         0
#define    TIMEOUT       4    // Auto off time-out value in hours
/*****************************************************************************
 * duration is in 100ms intervals (70 = 7 seconds)
 * duty is percent on; 0=full off, 100 or greater = full on
 * ramp is the transition speed 1=fastest transition, larger numbers are slower
 *****************************************************************************/
#define LENGTH1          7   // GREEN LED
                                                    /* Duration in tenths of a second */
unsigned char DURATION_SEQUENCE1[3][LENGTH1] = { 180,  90,  90,  30,  30,  30, 180,     // Walk in the Woods
                                                 180,  90,  90,  90,  90,  90,  90,     // Tuscany
                                                 180, 180, 180,  90,  90,  90,  90  };  // Winter Solstice
                                                    /* Percent on, 0 = off, 100 = full on */
unsigned char DUTY_SEQUENCE1[3][LENGTH1] =     { 100, 100, 100, 100, 100,  60, 100,     // Walk in the Woods
                                                  67, 100, 100,  38,  38,  60,  60,     // Tuscany
                                                   0, 100,  85,  40,  40, 100, 100  };  // Winter Solstice
                                                    /*  Transition Speed  */
unsigned char RAMP_SEQUENCE1[3][LENGTH1] =     { 35,  35,  35,  35,  35,  35,  35,      // Walk in the Woods
                                                 35,  35,  35,  35,  35,  35,  35,      // Tuscany
                                                 35,  35,  35,  35,  35,  35,  35 };    // Winter Solstice
#define LENGTH2          7   // RED LED
                                                    /* Duration in tenths of a second */
unsigned char DURATION_SEQUENCE2[3][LENGTH2] = { 180,  90,  90,  30,  30,  30, 180,     // Walk in the Woods
                                                 180,  90,  90,  90,  90,  90,  90,     // Tuscany
                                                 180, 180, 180,  90,  90,  90,  90  };  // Winter Solstice
                                                    /* Percent on, 0 = off, 100 = full on */
unsigned char DUTY_SEQUENCE2[3][LENGTH2] =     {  60,  30,  30,  10,  10,   0,   0,     // Walk in the Woods
                                                 100,  80,  80, 100, 100, 100, 100,     // Tuscany
                                                   0,   0,  45,  40,  40,  15,  15 };   // Winter Solstice

                                                    /*  Transition Speed  */
unsigned char RAMP_SEQUENCE2[3][LENGTH2] =     { 35,  35,  35,  35,  35,  35,  35,      // Walk in the Woods
```

FIG. 7A

```
                                        35,  35,  35,  35,  35,  35,  35,          // Tuscany
                                        35,  35,  35,  35,  35,  35,  35 };        // Winter Solstice
#define LENGTH3          7    // BLUE LED  806
                                        /* Duration in tenths of a second */
unsigned char DURATION_SEQUENCE3[3][LENGTH3] = { 180,  90,  90,  30,  30,  30, 180,     // Walk in the Woods
                                        180,  90,  90,  90,  90,  30, 150,         // Tuscany
                                        180, 180, 180,  90,  90,  90,  90   };     // Winter Solstice
                                        /* Percent on, 0 = off, 100 = full on */
unsigned char DUTY_SEQUENCE3[3][LENGTH3] =    {  0,   0,   0,  40,  40, 100,  10,          // Walk in the Woods
                                         0,   0,   0,   0,   0,   0,   5,          // Tuscany
                                       100, 100, 100, 100, 100,  39,  39  };       // Winter Solstice

                                        /*  Transition Speed  */
unsigned char RAMP_SEQUENCE3[3][LENGTH3] =    { 35,  35,  35,  35,  35,  35,  35,          // Walk in the Woods
                                        35,  35,  35,  35,  35,  35,  35,          // Tuscany
                                        35,  35,  35,  35,  35,  35,  35 };        // Winter Solstice

#define LENGTH4          7    // GREEN LED  808
                                        /* Duration in tenths of a second */
unsigned char DURATION_SEQUENCE4[3][LENGTH4] = { 180,  90,  90,  30,  30,  30, 180,     // Walk in the Woods
                                        180,  90,  90,  90,  90,  90,  90,         // Tuscany
                                        180, 180, 180,  90,  90,  90,  90   };     // Winter Solstice
                                        /* Percent on, 0 = off, 100 = full on */
unsigned char DUTY_SEQUENCE4[3][LENGTH4] =    { 100, 100, 100, 100, 100,  60, 100,          // Walk in the Woods
                                         67, 100, 100,  38,  38,  60,  60,          // Tuscany
                                          0, 100,  85,  40,  40, 100, 100,  };      // Winter Solstice
                                        /*  Transition Speed  */
unsigned char RAMP_SEQUENCE4[3][LENGTH4] =    { 35,  35,  35,  35,  35,  35,  35,          // Walk in the Woods
                                        35,  35,  35,  35,  35,  35,  35,          // Tuscany
                                        35,  35,  35,  35,  35,  35,  35 };        // Winter Solstice
#define LENGTH5          7    // RED LED  810
                                        /* Duration in tenths of a second */
unsigned char DURATION_SEQUENCE5[3][LENGTH5] = { 180,  90,  90,  30,  30,  30, 180,     // Walk in the Woods
                                        180,  90,  90,  90,  90,  90,  90,         // Tuscany
                                        180, 180, 180,  90,  90,  90,  90   };     // Winter Solstice
                                        /* Percent on, 0 = off, 100 = fulll on */
unsigned char DUTY_SEQUENCE5[3][LENGTH5] =    {  60,  30,  30,  10,  10,   0,   0,          // Walk in the Woods
                                        100,  80,  80, 100, 100, 100, 100,          // Tuscany
                                          0,   0,  45,  40,  40,  15,  15  };       // Winter Solstice
                                        /*  Transition Speed  */
unsigned char RAMP_SEQUENCE5[3][LENGTH5] =    { 35,  35,  35,  35,  35,  35,  35,          // Walk in the Woods
                                        35,  35,  35,  35,  35,  35,  35,          // Tuscany
                                        35,  35,  35,  35,  35,  35,  35 };        // Winter Solstice
#define LENGTH6          7    // BLUE LED  812
                                        /* Duration in tenths of a second */
unsigned char DURATION_SEQUENCE6[3][LENGTH6] = { 180,  90,  90,  30,  30,  30, 180,     // Walk in the Woods
                                        180,  90,  90,  90,  90,  30, 150,         // Tuscany
                                        180, 180, 180,  90,  90,  90,  90   };     // Winter Solstice
                                        /* Percent on, 0 = off, 100 = full on */
unsigned char DUTY_SEQUENCE6[3][LENGTH6] =    {  0,   0,   0,  40,  40, 100,  10,          // Walk in the Woods
                                         0,   0,   0,   0,   0,   0,   5,          // Tuscany
                                       100, 100, 100, 100, 100,  39,  39  };       // Winter Solstice
                                        /*  Transition Speed  */
unsigned char RAMP_SEQUENCE6[3][LENGTH6] =    { 35,  35,  35,  35,  35,  35,  35,          // Walk in the Woods
                                        35,  35,  35,  35,  35,  35,  35,          // Tuscany
                                        35,  35,  35,  35,  35,  35,  35,          // Winter Solstice
```

FIG. 7B

MICROCONTROLLER-CONTROLLED MULTI-COLOR LED APPARATUS

BACKGROUND OF THE INVENTION

1. Field of the Invention

Our invention is directed to designing and storing light shows to be used in light objects. Light objects include any object that is intended to provide light for illumination or decoration. Light objects, therefore, include projectors, light bulbs for conventional light sockets, internally lit sculptures, night lights, etc. Our invention is also directed to novel light shows for use in light objects. More specifically, our invention is directed to using various formulae and/or CIE (Commission Internationale de l'Eclairage) coordinates to define the colors to be used in a light show and the manner in which the colors change over the course of a light show.

2. Description of the Related Art

Home lighting effects have proven important and desirable to consumers seeking settings anywhere from soothing to dramatic. In particular, dimmers and specialized light shades have provided consumers with the ability to create warm and intimate settings. Neon light sculptures have enjoyed popularity in connection with adding color and a dramatic effect to one's home. Candles are still routinely used to create a pleasant ambience.

There are, of course, numerous other examples of lighting effects employed by individuals to create pleasing environments in their living spaces, including decorative light/illumination objects. U.S. Pat. No. 6,685,339 (directed to a sparkling light bulb), U.S. Pat. No. 6,459,919 (disclosing color controllable track lighting), and U.S. Pat. No. 5,924,784 (directed to simulated candles) describe various light objects that produce light shows for a user's viewing pleasure. Light objects include any object that is intended to provide light for illumination or decoration. Light objects, therefore, include projectors, light bulbs for conventional light sockets, internally lit sculptures, night lights, etc.

With advances in light emitting diodes (LEDs) and the growing availability of inexpensive lighting products using them, LEDs are becoming a popular way to produce aesthetically pleasing lighting effects. With substantially instantaneous activation and deactivation of the light emitted from LEDs, they provide more versatility than conventional lighting devices, which are relatively slow to reach their optimum brightness, and fade out when shut off (e.g., fluorescent and incandescent lights). This versatility in LED lighting devices has led to the use of LEDs to mimic flickering flames, as is discussed in U.S. Pat. No. 5,924,784. In addition, the variety of colors of LEDs available and the ability to mix easily the lights of different color LEDs have led to the use of colored LEDs in various home lighting devices. For instance, U.S. Pat. No. 6,801,003 discusses the use of LEDs in providing light shows in decorative illumination objects, room illumination, and the like.

In operation, a single LED emits light of a dominant wavelength, or a very narrow range of wavelengths. (For purposes of simplicity, we will refer to the dominant wavelength of an the LED. That term should be interpreted also to include a narrow range of wavelengths.) For instance, a blue LED will emit a dominant wavelength of light in the blue range of the color spectrum. This dominant wavelength is not substantially controllable for a given LED (although the dominant wavelength and intensity can drift slightly with temperature fluctuations, for instance). The intensity of the light, however, can be controlled for a given LED. For instance, LEDs can be controlled by altering the applied current so as to vary the intensity of the light of the LED's dominant wavelength. This can be achieved by a number of means; however, pulse width modulation (PWM) is preferred. Preferably, a microcontroller is used in the control process, with the microcontroller including control logic that receives instructions from a memory or an outside source regarding the operation of the LEDs. With PWM, the microcontroller sets a cycle for each of the LEDs, and within that cycle, controls the ON time and the OFF time of the LED, such that a constant current is supplied to the LED for a portion (or portions) of cycle (i.e., the pulse width(s) of the duty cycle). By altering the pulse width of the duty cycle, the LED is controlled to be on for a portion of the cycle, and off for the remainder of the cycle. Thus, the diode flickers on and off as the duty cycle is repeated over time. This flicker, however, occurs so rapidly that an observer perceives a constant light emission, with the intensity of the light becoming greater as the pulse width is increased. Thus, greater control can be achieved as compared to conventional lights, which cannot be turned on and off as rapidly due to the time it takes to reach full intensity (e.g., heat the filament in an incandescent bulb) and cease light emission (e.g., wait until the filament cools).

Consequently, in LED lighting, an observer will observe a color corresponding to the dominant wavelength for the LED, and the variation in the pulse width will have a dimming effect. This method of controlling LEDs is known in the art, and thus will not be discussed in more detail. Other methods of operating LEDs are also known, and the use thereof would be obvious to one of ordinary skill in the art.

When different-colored LEDs are used together, the lights of the individual LEDs can be mixed together. For instance, U.S. Pat. No. 6,801,003 discusses a system in which the wavelengths of light from different-colored LEDs are combined. The mixture can be achieved by shining the lights on the same surface, placing the LEDs in close proximity to each other, shining the light from the LEDs through a diffuser, transmitting the lights through optical devices, and the like. When the lights of the different wavelengths are effectively mixed, an observer perceives the received mixture of wavelengths as a single color. The perceived color can then be altered by adjusting the respective intensities (e.g., duty cycles) of the different LEDs. This allows for color changing effects in the perceived light.

Even though the perceived color is varied by adjusting the relative intensities of the LEDs, each LED still only emits light of its dominant wavelength. Consequently, the specific wavelengths of light used to create the lighting effects are not indicative of the color changes perceived by an observer.

The perceived color, however, may be defined in accordance with a standard known as the Commission Internationale de l'Eclairage (CIE) classification. The CIE classification is provided in the form of a color chart, which is shown in FIG. 1, although shown in black and white here. Representations of the actual colors in the chart can readily be obtained from available sources such as "Color Vision and Colorimetry: Theory and Applications," by Daniel Malacara (SPIE Press 2002).

A single LED, emitting a dominant wavelength, provides a perceived color represented by one point (i.e., one set of coordinates) on the CIE chart. Consequently, two different color LEDs can be represented by two different points on the CIE chart. When those two LEDs are operated together to combine their emitted wavelengths of light, the perceived light obtainable by varying the relative intensities of the two LEDs is defined by a line on the CIE chart connecting the two points.

It is generally known in the art that LEDs can be used in combination to obtain different colored lights, as defined on a CIE chart. For instance, U.S. Pat. No. 6,498,440 discusses the dynamics of obtaining differently perceived light colors along a line connecting two points on a CIE chart corresponding to two specific LEDs. U.S. Pat. No. 6,411,046 describes the combination of the light emission of multiple LEDs of different colors, which LEDs are controlled to maintain a consistent white light (as defined on a CIE chart) under various ambient conditions.

By varying the relative intensities of combined light from two or more LEDs, the LEDs can operate to produce a wide array of differently-perceived colors.

With all of these advancements, however, there remains room for improvement in the art of LED operation and light show design and implementation.

In particular, in conventional illumination objects in which LEDs are implemented to display a light show in which the perceived light color changes over time (for instance, a color wash), a microcontroller is typically connected to a memory which stores instructions for the operation of the LEDs during the course of the show. Specifically, a look-up table is conventionally used to store data indicating the respective LED settings for each point during the course of the show. Thus, for each point (i.e., new setting at a given moment in time) in the show, the look-up table includes data for the specific pulse width setting for each different LED used in producing the light show. Thus, over the course of the show, the LED settings are changed per specified unit of time. These different color points are provided one after the other to provide a color wash that appears to flow seamlessly from one color (i.e., point) to the next over the course of the show. Of course, the distance between the color points used will affect the perceived speed and the seamlessness of the show. This can lead to a relatively large amount of data, particularly if multiple light shows are to be stored in the memory and the device is a simple device for which the cost of memory chips is a significant portion of the manufacturing cost. Also, if a modular, replaceable memory card is to be used in a lighting device, as is a preferred improvement in our invention, the size of the memory is the primary cost of the unit (i.e., memory card) to be manufactured and sold.

We have overcome this shortcoming of conventional systems by developing a novel method of defining and storing data concerning the operation of a light show, which requires less memory than the conventional method of defining and storing data for every color point in the show, and is easier to design and program.

In addition, while the relationship between a CIE chart and particular LEDs is known in the art, we have improved on the art by developing novel light shows which we believe will be desirable to an observer, and defining those light shows with respect to a specified area on the CIE chart obtainable through the combination of a set of colored LEDs.

SUMMARY OF THE INVENTION

In one embodiment, our invention is directed to a light object including a plurality of LEDs of different colors, which runs a program for controlling the LEDs to display a multicolor light show. The program is defined by a starting color point of the light show (which may simply be defined as the current color point), an ending color point of the light show, and timing information indicative of timings related to the light show.

The starting and ending points can be defined with respect to the CIE chart, specific settings (i.e., intensity lead values) for the different LEDs to be used in producing the light show, and the like. The timing information may include information concerning the length of time of the light show and/or the ramp speed(s) of the LEDs used in the light show. The ramp speed refers to the rate of change of the intensity level of the LEDs. The ramp speed can be common to all of the LEDs, or individualized for each LED used in the light show.

With this invention, the intervening color points of the light show between the starting color point and ending color point need not be stored in a look-up table. Instead, a microcontroller can be programmed to calculate the intervening points using the data identifying the starting and ending (or target) points and the timing information for traveling between those points to produce the light show, as will be discussed in more detail later. This allows a memory storing one or more light shows to be reduced in size and cost. It also provides a light show designer with a simplified process for defining and altering a light show in order to achieve a desired effect.

Our invention also is directed to a method of designing, storing, and operating light shows using features discussed above with respect to the novel light object of our invention. Further, our invention encompasses computer programs for performing light shows for light objects discussed above, and computer-readable media storing such programs.

In a preferred embodiment, our invention is directed to a lighting object for providing a light show to an observer. The lighting object includes at least two LEDs, each of which emits light of a different wavelength, and a microcontroller for independently controlling the intensity levels of the at least two LEDs to vary colors perceived by the observer during the light show. The light show includes at least one segment for which a memory stores, for each of the at least two LEDs, a target intensity level and timing information. The microcontroller calculates a plurality of intermediate intensity levels for the at least two LEDs for the duration of the segment based on a starting intensity level, the target intensity level, and the timing information for each of the at least two LEDs. The microcontroller also controls the at least two LEDs to operate at each of the calculated intermediate intensity levels during the segment.

A preferred method according to our invention includes steps for providing a light show to an observer. Specifically, the method includes providing at least two LEDs, each of which emits light of a different wavelength, and independently controlling the intensity levels of the at least two LEDs to vary colors perceived by the observer during the light show. The method also includes a step of reading from a memory, for each of the at least two LEDs, a target intensity level and timing information for at least one segment of the light show. The method also includes calculating a plurality of intermediate intensity levels for the at least two LEDs for the duration of a segment based on a starting intensity level, the target intensity level, and the timing information for each of the at least two LEDs. In addition, the method includes controlling the at least two LEDs to operate at each of the calculated intermediate intensity levels during the segment.

In another embodiment, our invention is directed to novel light shows, which are performed using different-colored LEDs, which operate in combination to produce perceived light colors existing within a defined area of the CIE chart. The version of the CIE chart referred to throughout our application is CIE 1931 (although our invention is not limited thereto). We note that CIE 1976 is also widely used. One of ordinary skill in the art would understand that there are programs available which can convert coordinates from one chart to coordinates in the other.

Specifically, our invention is directed to light shows in which different-colored LEDs operate in combination to produce a light show of changing colors, as perceived by an observer, wherein the perceived colors exist within a bounded area of the CIE chart defined substantially by the coordinates (0.15, 0.1), (0.12, 0.19), (0.58, 0.42), and (0.65, 0.35), in one embodiment; (0.58, 0.42), (0.7, 0.3), (0.6, 0.3), and (0.56, 0.4), in another embodiment; and (0.15, 0.02), (0.1, 0.1), (0.13, 0.2), (0.24, 0.31), and (0.34, 0.16), in yet another embodiment.

Similarly, our invention is directed to a method including the steps of choosing a plurality of different-colored LEDs, selecting an area of the CIE chart in which those LEDs can operate, selecting a starting point of the light show within that area, selecting an ending point within that area, and producing a light show defined by a path of points substantially within the selected area between the starting point and the ending point.

Our invention is also directed to apparatuses performing the novel light shows, as well as computer programs for controlling the light shows and computer-readable media storing such programs.

A better understanding of these and other features and advantages of the invention may be had by reference to the drawings and to the accompanying description, in which preferred embodiments of the invention are illustrated and described.

BRIEF DESCRIPTION OF THE DRAWINGS

FIG. 5 is a table setting forth the coordinates of starting and ending points of preferred color shows according to our invention.

FIGS. 7A and 7B show an example of header information for a computer program according to our invention.

DETAILED DESCRIPTION OF THE INVENTION

Defining and Storing a Light Show

Figure 1:
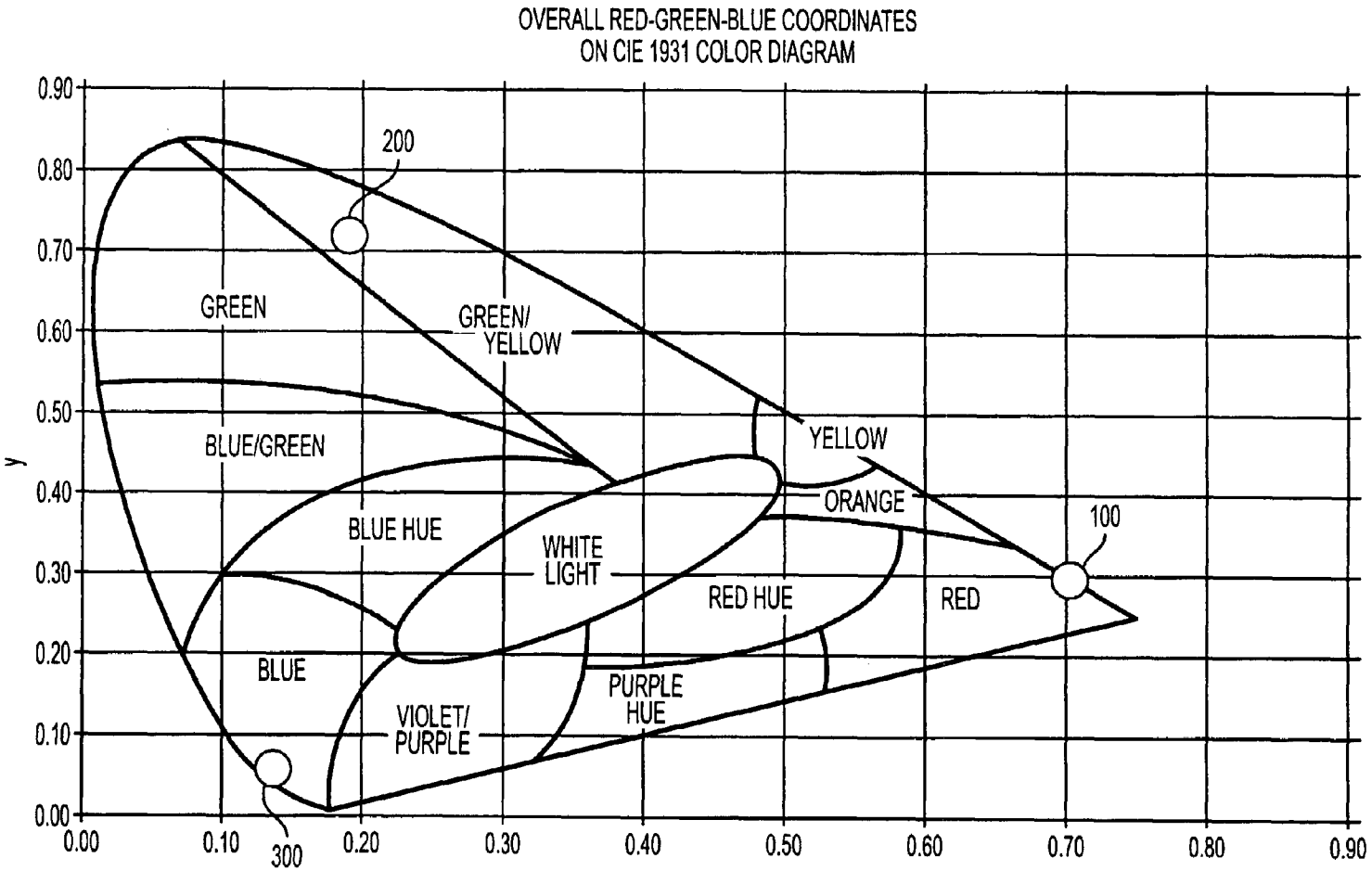
FIG. 1 shows the CIE chart with three coordinates corresponding to three different-colored LEDs.

As discussed above, one embodiment of our invention is directed to defining and storing a light show in such a way as to reduce the memory needed to store the show and provide a designer with ease of control over programming and altering the light show.

Our improved system involves defining the target (or ending) color point of the light show, and in some cases, the starting color point. A color point refers to the settings of the LEDs at a given moment of the light show, which provides a specific perceived color. (As the settings of the LEDs change over time in accordance with the instructions for the light show, the successive color points of the show can ultimately be perceived as a "wash" or "waves" of colors.) Because we are discussing "perceived" colors, the starting color point does not directly correspond to the wavelengths of light emitted by the LEDs used in the color show, inasmuch as those wavelengths are substantially constants. The starting and target color points can, however, be defined by coordinates on the CIE chart, or alternate system for defining viewer-perceived colors.

The color points can also be defined by the relative intensities of the lights emitted from the LEDs used to produce the color show (i.e., the operational settings for the different LEDs at specified points of the light show). For instance, a color point can be defined by the specific intensity level (set at that point in time) for each LED being used. As will be understood, color perceived by a viewer at such a color point will be a factor of the combination of relative intensities of the LEDs and the dominant wavelength of each LED. Preferably, intensity levels will be defined by the duty cycles of the currents applied to the LEDs (e.g., as a percentage of full activation of the LEDs).

It will be understood by one of ordinary skill in the art that the combination of the lights from different-colored LEDs at specified intensities will directly correspond to a set point on the CIE chart. Therefore, the different possible methods discussed above for defining the color points (i.e., using CIE chart coordinates or specific LED settings) achieve substantially the same end with respect to defining a perceived color.

We note, however, that there are many ways in which the lights from the different LEDs can be combined. In some methods, especially where diffusers are not used and the LEDs are merely placed in close proximity to each other, a user may perceive different colors close to the emission points of the LEDs (i.e., may perceive the colors of the individual LEDs). When we discuss color points, we refer to the color of a substantially complete mixture of the lights from the different LEDs, even though there may be observable portions of the display in which the user sees distinct colors corresponding to the wavelengths from the individual LEDs, rather than the complete mixture.

The starting and ending color points are similar to the first and last entries in a look-up table setting forth all of the points of a color show in a conventional system; however, instead of providing all of the intervening points from the conventional look-up table, our invention can dispense with the need to determine and store each and every intervening color point. To achieve this effect, timing information is provided. The timing information defines timing aspects of the light show and LED control.

Using the timing information, a microcontroller may calculate on its own all of the intervening color points in the light show between the perceived starting and ending points, which correspond to starting and ending settings for each of the LEDs. This saves valuable memory space that would otherwise have to be devoted to complex look-up tables for various light shows. It also saves the effort involved in compiling such a look-up table.

The timing information preferably includes information concerning the duration of the show, from display of the starting color point to the ending color point.

The timing information also preferably includes information concerning the ramp speed for the LEDs, either as a whole, or individually. The ramp speed refers to the speed of intensity change of the LEDs. Generally, ramp speed may be defined as the unit of time it takes the LED to change one intensity level increment (for that particular show), with each increment being equal. This can also be defined as the change of intensity per unit of time. The ramp speed may be constant for a given LED for a given light show, or may change over the course of the light show.

As discussed above, LEDs may be controlled by PWM such that the pulse width of a constant current applied for a portion of the duty cycle is varied to alter the intensity of the light emitted from the LED. The intensity level of the LED can be measured as a fraction of the cycle during which the constant current is applied, which can be expressed as a percentage, among other ways. When an LED is not on, the pulse width is at 0%. When a constant current is applied to the LED for half of the cycle, the intensity of the LED is at 50%.

Ramp speed may be defined, in one embodiment, as the amount of time between changes of intensity of one percentage point of total intensity, for instance. Consequently, if the ramp speed of an LED is set at two seconds, then during the course of the light show that LED will change its intensity by one percentage point every two seconds until reaching the target value (i.e., the intensity value of the LED, or other measure, defining the ending color point). In a more preferred embodiment, ramp speed is defined as the percentage change per second. Of course, the rate can be defined in any one of a number of ways, as will be understood by one of ordinary skill in the art. Also, the ramp speed can be a positive or negative value, depending on whether the intensity of the LED is to be increased or decreased during the light show. Alternatively, the microcontroller can be programmed to increase or decrease the intensity setting by comparing the starting intensity setting to the ending intensity setting, rather than introducing negative values into any necessary equations. Thus, for instance, if the microcontroller determines that the value of the ending setting is lower than the value of the starting setting, the microcontroller will decrease the intensity of the LED at a rate set by the given ramp speed.

With the timing information provided, the microcontroller controlling the LEDs can be provided with logic that calculates the intervening color points between the starting and ending points for each LED. The starting intensity may be a specified intensity level, or whatever the current intensity level is. The ending point is more preferably a target intensity level which the program moves toward during the light show. The program may or may not reach the target value before the end of the show, or the particular segment of the show. The logic reads the timing information from memory and adjusts the duty cycle for each LED in accordance with the ramp speed and target intensity. The intensity for each LED is adjusted until the target value is reached or the end of the duration of the show is reached. At this time, the microcontroller will read the next set of timing information from memory and begin again (e.g., move on to a new segment of the show). Of course, if the target intensity is reached prior to the end of the show (or segment), the microcontroller will hold the intensity of the LED until the duration has lapsed. If a continuously changing show is desired, the ramp speed may be set such that the target intensity is not reached prior to the end of the show, therefore the target value will never be reached. Likewise, the microcontroller may be configured to ignore the duration, and load the next intensity and ramp speed as soon as the target intensity is reached.

The programming for achieving this would be readily understood by one of ordinary skill in the art. Accordingly, a detailed description of the many different ways of programming the microcontroller will not be provided herein. However, an explanation of a preferred mode of operation will be discussed below.

With the starting and target intensities defined, and timing information provided, the microcontroller can calculate the intervening points when instructed to start the thus-defined light show. The timing information related to the duration of the light show (or segment thereof) preferably defines the length of time from the start of the light show until the end of the show or segment. The timing information preferably also defines the ramp speed(s). The ramp speed can be used to define the intervening color points that are displayed between the starting and target intensities during the defined duration of the light show. With respect to the CIE chart, the intervening color points define a path between the starting and ending points. There are numerous paths that can be taken between those points. Adjustment of the ramp speed(s) will alter the path.

For instance, if different ramps speeds are set for each different LED to be used in the light show, the relationship among those LEDs and ramp speeds will define the path between the starting and ending points. The different ramp speeds may be set such that the rate of intensity change may be high for one color, but low for another color. In addition, whether respective ramp speeds are positive or negative (i.e., which LEDs are increasing in intensity and which LEDs are decreasing in intensity over the course of the show) will also affect the path. Further, the differences in total intensity change over the course of the light show for the various LEDs will also affect the path. An example of the path control will be discussed below with respect to the embodiment corresponding to FIG. 2.

Figure 2:
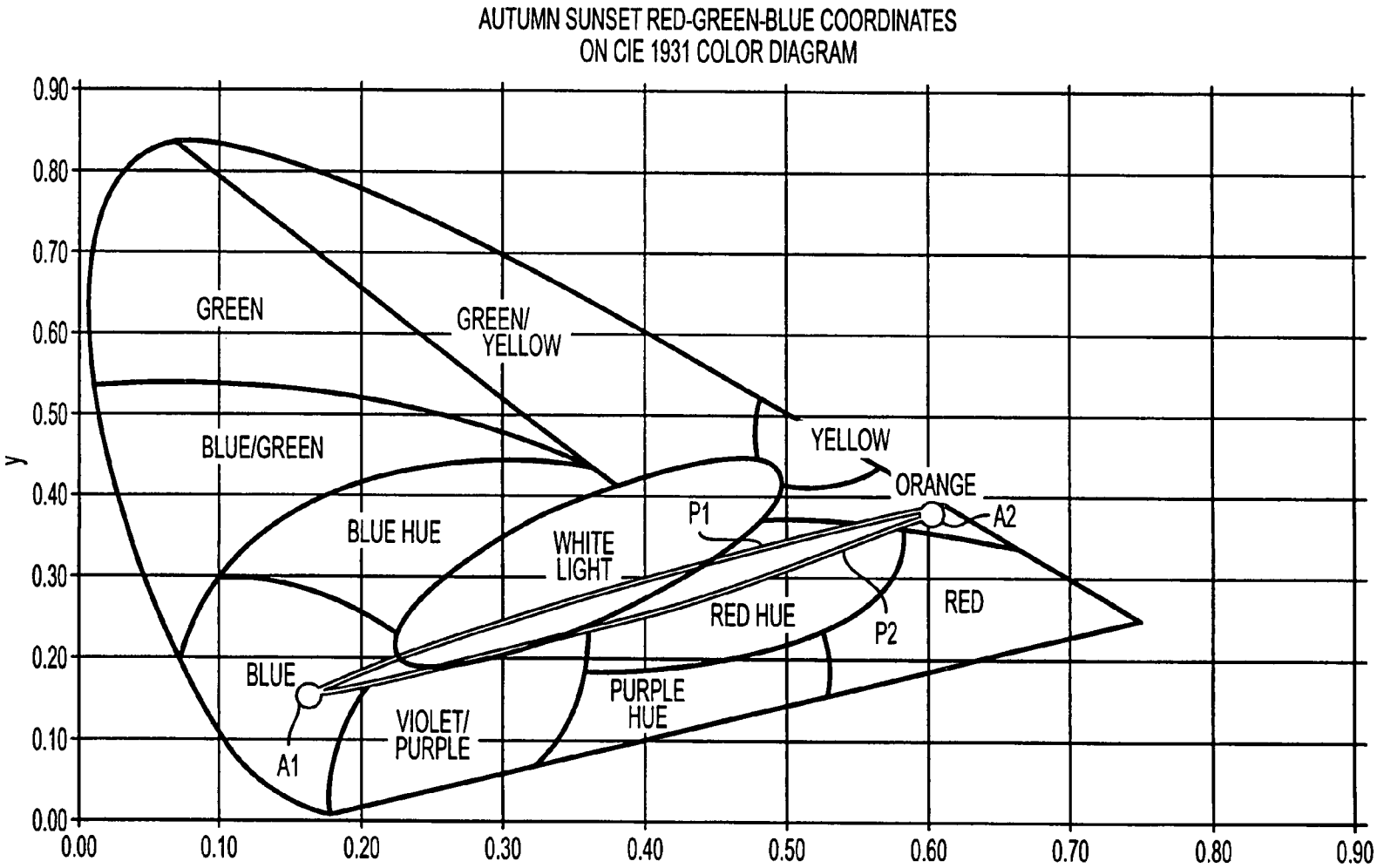
FIG. 2 shows the CIE chart with the starting and ending points of a preferred light show according to our invention.

FIG. 2 shows one example of a preferred light show ("Autumn Sunset") achieved according to our invention. The light show includes a starting point A1 and an ending point A2. The light show is achieved using three different-colored LEDs. Specifically, the light show of this embodiment is achieved by combining the lights emitted from a red LED, a green LED, and a blue LED. The LEDs for this embodiment emit light of wavelengths corresponding to points 100, 200, and 300 in FIG. 1. The coordinates for those points are set forth in the table in FIG. 5, and are referred to as coordinates "Red" (100), "Green" (200), and "Blue" (300) in the table. With the LEDs emitting lights corresponding to points 100, 200, and 300, the combination of the LEDs can achieve any perceived color falling on the CIE chart in a triangular area defined by the connection of those three coordinates.

The displayed path P1, in FIG. 2, between starting color point A1 and ending color point A2 is defined by the intervening color points (not shown) in the light show. The path of the intervening color points corresponding to P1 are defined by the relationship of ramp speeds and the relative (total) changes in intensity of the three different-colored LEDs. The number of intervening color points calculated by the microcontroller is dictated by the duration, ramp speed(s), and the difference(s) in starting and ending intensities, or it can be preset.

The starting and ending points (A1 and A2) are (0.1645, 0.1549) and (0.6039, 0.3785), respectively, on the CIE chart. In FIG. 5, "Autumn 1" shows the coordinates on the CIE chart of the starting point of the "Autumn Sunset" color show "Autumn 2" shows the coordinates of the ending point (A2). The duration of the light show is set at 18 seconds. The ramp speeds for the red, green, and blue LEDs are each set to 5% per second. Also, the change in intensity (from the starting point to ending point) for each of the red, green, and blue LEDs is 95%, 25%, and 82%, respectively. (In other words, the change in intensity setting for the green LED from start to finish is 25 percentage points of total possible intensity.) Because the required change in intensity is less for green than the other LEDs (and because the intensity of the blue LED reduces over the course of the show), the path P1 of the color points curves toward the green area of the CIE color chart early on in the light show. However, because of the smaller total change in intensity of that LED, the green LED reaches the intensity value needed to display the ending color point ("target intensity"), when combined with the target intensities of the other LEDs, earlier in the show than the other LEDs. Accordingly, the green LED maintains that target intensity for the remainder of the light show. In other words, the ramp speed defines the speed of intensity change from the starting intensity of the LED to the target intensity needed to achieve the ending color point when combined with the target intensities of the other LEDs. Once the target intensity is reached for any one LED, the LED maintains that intensity until the end of the duration of the light show, with the ending color point being achieved when each of the LEDs being used reaches its target intensity.

Because the green LED reaches its target intensity early in the light show, during the remainder of the light show, the other LEDs increase or decrease in intensity, with the green LED maintaining a constant intensity. This causes the path of the show along the CIE chart to bend away from the green range of the chart back toward the ending color point, because the intensities of the other two LEDs balance out the light combination (particularly the increase in the intensity of the red LED).

The path can also be altered by varying the speed, rather than just the total change in intensity among the LEDs. Thus, if the designer of the light show wishes to alter the displayed colors, to have less hues in the dark red range, he/she may decrease the ramp speed of the red LED, so as to prevent the path from curving out toward the darker reds, for instance. Further, whether certain LEDs are being increased or decreased in intensity will affect the path. This system can also be used to avoid or achieve a certain perceived color more easily than rewriting an entire look-up table. Thus, the present invention provides a light show designer with an easy control mechanism for defining and manipulating the colors displayed during the light show.

If all of the LEDs reach their target intensities before the end of the duration of the light show, the corresponding color point will be maintained until the end of the show. Conversely, if the ramp speeds are set low enough, it is possible that the specified ending color point will not be reached before the end of the duration of the show.

Figure 3:
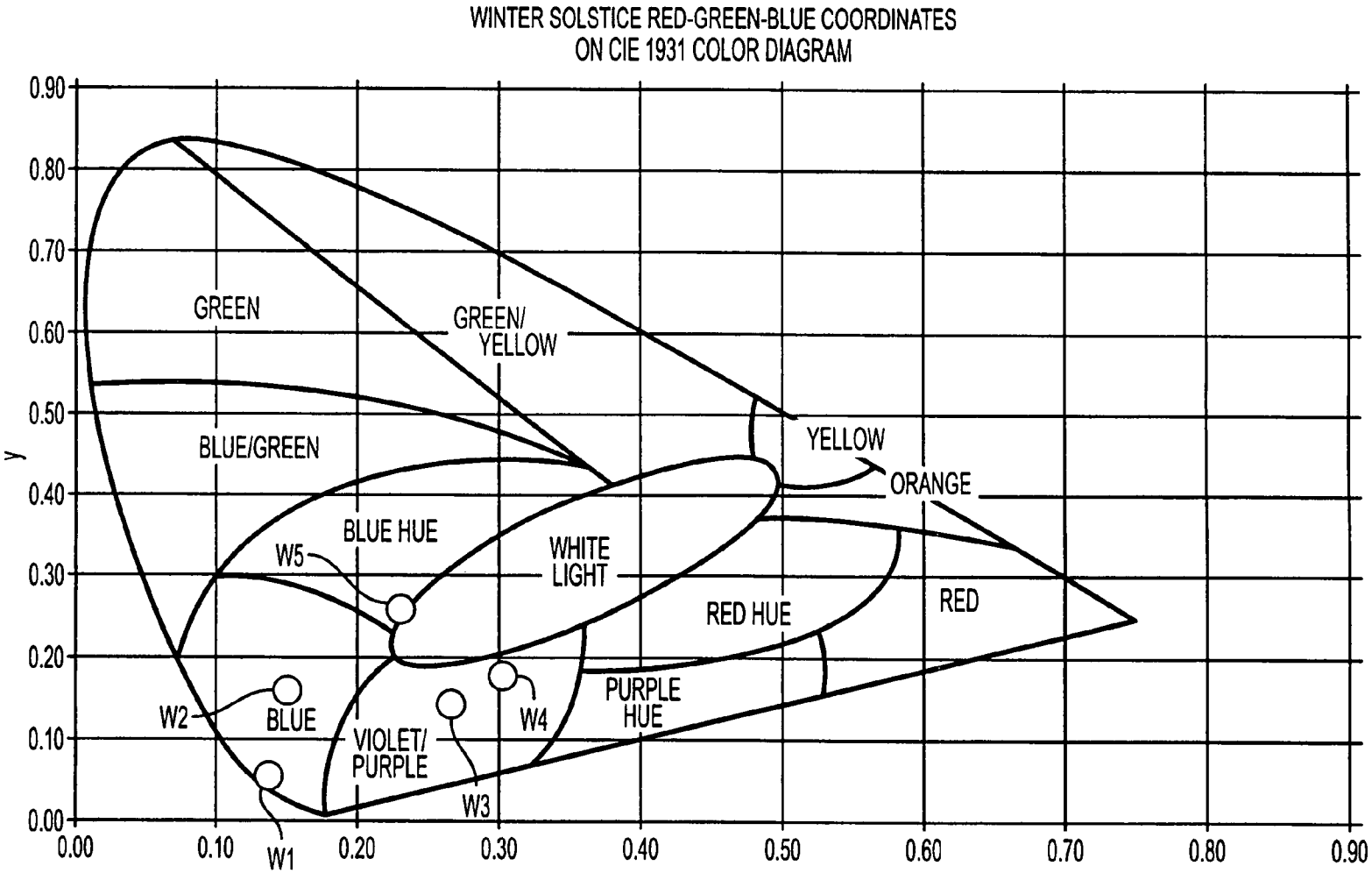
FIG. 3 shows the CIE chart with sets of starting and ending points of another preferred light show according to our invention.

Instead of one starting point and one ending point for a given light show, a light show can also be constructed from a plurality of segments, each defined by a starting color point and an ending color point. FIG. 3 shows the starting and ending color points for a light show with multiple segments.

Specifically, FIG. 3 is a CIE chart showing points W1, W2, W3, W4, and W5. Those points define a light show ("Winter Solstice") constituted by individual segments, each of which has a starting color point and an ending color point. W1 and W2 define a first set of starting and ending color points, respectively. W2 and W3 are starting and ending points, respectively, of a second segment. W3 and W4 are starting and ending points, respectively, of yet another segment. W4 and W5 are starting and ending points, respectively, of a final segment. Each segment can be defined and operated as discussed above with respect to the Autumn Sunset light show, which contains only one set of starting and ending points. Thus, timing information including the duration of the segment and the ramps speeds for the three LEDs used for the show may be provided for a first segment W1-W2. Separate timing information may be provided for each other segment.

With a light show using multiple segments, a designer of light shows may exert greater control over the path of the intervening color points, so as to provide a more sinuous pattern across the CIE chart. Thus, the designer may have an easier time programming a light show with a greater range of colors. In addition, using different segments allows the designer to provide different timing information throughout the entire light show. In particular, different sets of ramp speeds may be programmed for each segment. Further, when the ramp speeds are high enough that the target color corresponding to the ending color point is achieved before the duration for that segment has ended, then the ending color point is maintained. To an observer, this gives the appearance that the light show pauses, to hold a preferred color for specified time, before continuing again with the wash of colored lights. With the combination of ramp speeds, it may even appear to the user as if the light show slows to a specific color point (i.e., the ending color point for a given segment), and hesitates for a moment before changing again.

As would be understood by one of ordinary skill in the art, the use of multiple segments for a given color show can provide the designer with many options for varying the effect of the light show, as perceived by an observer.

Once the timing information concerning the duration of a given segment indicates that the segment is completed, the microcontroller operating the light show may switch to the next segment, with that segment's respective data being used to calculate the settings.

FIG. 5 indicates the specific coordinates on the CIE chart for starting and ending points of the "Winter Solstice" light show (W1-W5 correspond to Winter 1-Winter 5, respectively).

Figure 4:
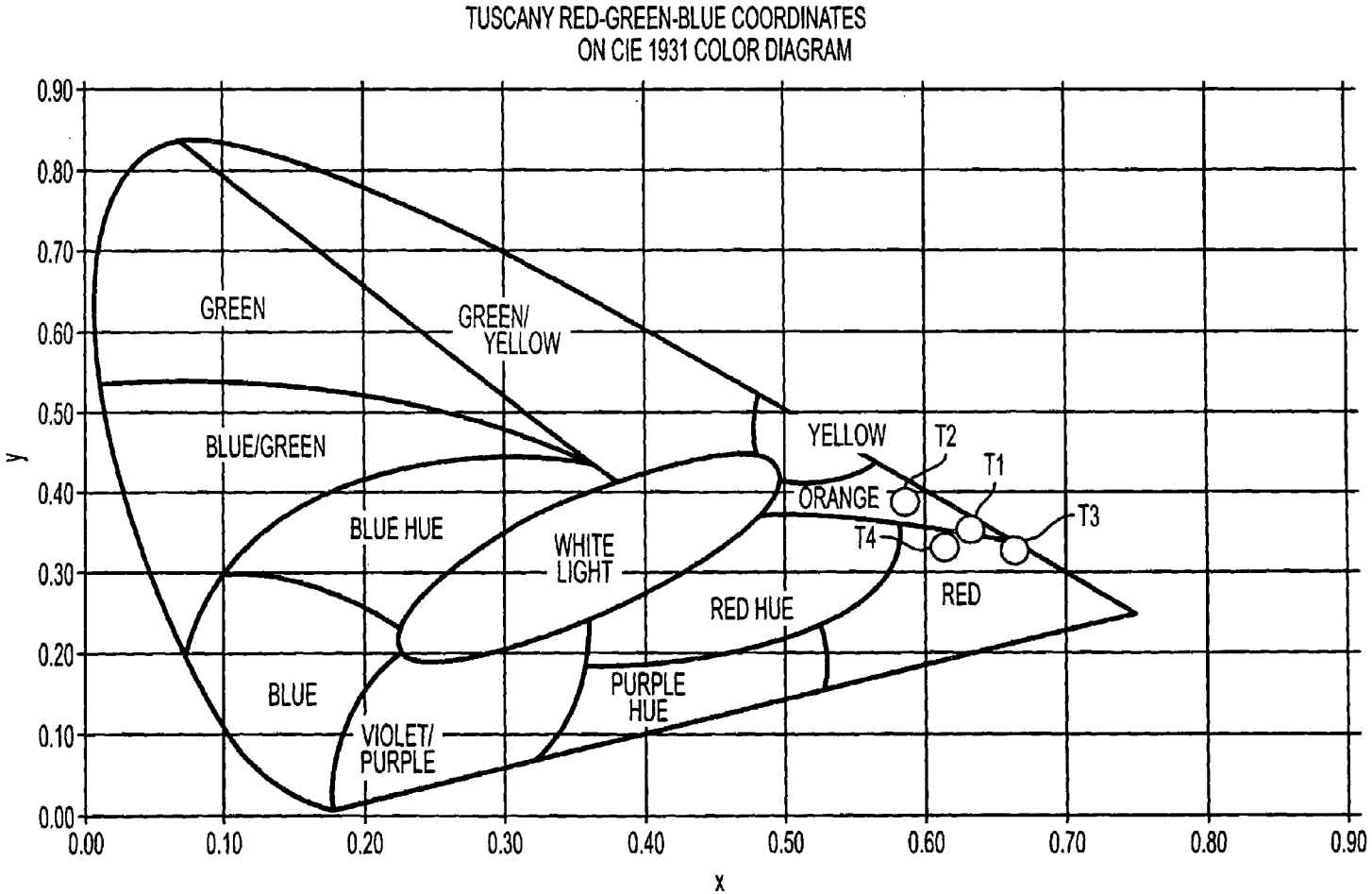
FIG. 4 shows the CIE chart with sets of starting and ending points of yet another preferred light show according to our invention.

FIG. 4 is a CIE chart showing the starting and ending points of various segments of a light show entitled "Tuscany". Points T1 and T2 define a first segment, T2 and T3 a second segment, and T3 and T4 a third segment. FIG. 5 sets forth the specific coordinates on the CIE chart for points T1-T4 (Tuscany 1-Tuscany 4). The Tuscany light show provides a soothing light show, focused on red and orange hues, that provides a pleasurable and relaxing experience for an observer.

Once each of the light shows has reached the end of its programmed duration, the light show may end. An observer may wish to use a light object exhibiting the light show for many hours, to provide a pleasurable home or work environment; however, the duration of the light show from the starting color point to the ending color point (or to the ending color point of the last segment, when multiple segments are provided) may be on the magnitude of seconds or minutes. Thus, it is more preferable that the light shows have the ability to cycle (loop) through the displayed colors many times, in order to prolong the visual experience.

A number of different techniques may be employed to achieve a prolonged experience. The light show can be started again at the starting color point of the first segment; however, the jump from the ending point to the starting point may be noticeable to an observer (unless the starting and ending point are proximate or identical to each other). This jump in color can upset the relaxing nature of the pattern, and is generally not desired for a relaxing light show.

In other embodiments, the light show may be displayed in reverse order, so that the displayed colors are displayed in reverse order from the ending point of the last segments to the starting point of the first segment. Then, once the original starting point is obtained, the color show may start over again. This process may be repeated as necessary.

Rather than displaying the shows in reverse order, the light show may be programmed such that the microcontroller is instructed to form a loop by plotting a path of color points from the ending color point of the last segment to the starting color point of the first segment. In effect, this method creates an additional segment, with the starting point of the additional segment being (or close to) the ending point of the last segment, and the ending point of the additional segment being the same as the starting point of the first segment. Thus, a loop is created. Such an additional segment is shown in FIG. 2 by path P2.

Preferably, the memory storing the show also stores information instructing the microcontroller on how may times to cycle through the light shows or for how long to cycle through the segments. Alternatively, this information can be stored in the program memory, so that it is standard for each light show, further reducing the memory size requirements. Thus, there may be an automatic shutoff after a set period. Alternatively, the light show may proceed continually until a user shuts off the device or alters the programming. As would be understood by one of ordinary skill in the art, other methods may be employed to cycle through a light show multiple times. For instance, the segments may be interconnected in the fashion of figure-eight patterns and the like, and the controller may control the light show such that the path is altered randomly at intersections of multiple segments, to provide a more random lighting effect. While obvious modifications are encompassed by our invention, all of the possible modifications using the principles discussed above will not be set forth herein.

Preferred Example

FIGS. 7A-7B shows an example of a header file 800 for a program (in C language) for operating three different color shows using a microcontroller.

In this example, the microcontroller controls six LEDs of three different colors. Specifically, there are instructions relating to two green LEDs (802 and 808), two red LEDs (804 and 810), and two blue LEDs (806 and 812). There are three different light shows defined in program header file 800 (i.e., shows 824, 826, and 828).

The present example includes three primary variables in the control program corresponding to header file 800. Those variables include "duration," "duty," and "ramp."

Duration refers to the length of a segment of the light show being performed. In this example, each show has seven segments. For instance, with respect to green LED 802, there are seven defined segments 822A-822G for light show 822.

Each value 822 refers to the time, in milliseconds, before the segments ends, and a new segment begins. Thus, the first segment (corresponding to 822A) lasts 18.0 seconds, after which the program moves to the next segment, corresponding to 822B, which lasts 9.0 seconds.

For each duration 822A-G, there is a corresponding duty. Specifically, there are corresponding duty cycle values 832A-G. Duty value 830 is the target intensity value for the segment of the corresponding duration 820. Specifically, it is the duty cycle in pulse width modulation of the LED (i.e., the period of the cycle during which the LED is on). As discussed above, this is only one method of defining an intensity value for an LED.

Ramp 840 is the value corresponding to the rate of change of the intensity value (duty value 830) of the associated LED. In this example, the rate of change is $\pm 1/(\text{ramp } (1/f_{pwm}))$, where ramp is the listed ramp value (e.g., 832A-G), $f_{pwm}$ is the cycle rate of the pulse width modulation signal driving the LEDs (e.g., 120 Hertz). Thus, $1/f_{pwm}$ is the period of one cycle of the pulse width modulation (e.g., 8.33 milliseconds).

Consequently, the rate of change in this example is the period of time between 1% changes in the duty cycle (intensity level), in the course of moving toward the target intensity value (duty 830). In this instance, the period of time is measured by the number of periods of the pulse width modulation cycle that cycle through before the duty cycle is changed by 1%. Thus, ramp value 842A indicates that the microcontroller should let the pulse width modulation period cycle through thirty-five times at the current setting before changing the duty cycle value 1%.

Thus, duration value 820 dictates the length of time of each segment of the light show. The duty value 830 dictates the target intensity value of the LED for the corresponding duration 820. The ramp value 840 dictates the rate of change of the LED intensity value (i.e., duty value 830) in moving towards the target duty value 830. With the program, the microcontroller can be instructed to, during the given duration of a segment, change the intensity of each of the LEDs by one percentage point at the given rate for each LED, toward the stated target value. This target value may be achieved during the duration of a segment, in which case, the intensity value stops changing, or the target intensity value may not be reached by the expiration of the duration of that segment. After the end of the segment, a new segment is read out and the microcontroller is controlled in accordance with the corresponding target intensity value and ramp speed for that segment.

As will be understood by one of ordinary skill in the art, this is only one example of a header file for software to be used in controlling a microcontroller in accordance with our invention. Other software programs may be used to implement the necessary control, and the variables may be alternatively defined to achieve the changes in intensity value over various segments of the light shows.

Preferred Light Shows

As discussed above, using three colored LEDs, one each of red, green, and blue, allows a designer to define light shows with just about any perceived color in an area of the CIE chart bounded by lines connecting the three coordinates on the CIE chart corresponding to the color of light emitted by those different LEDs.

Numerous different LEDs are available, of widely varying colors. One of ordinary skill in the art would understand that the LEDs to be used to produce any particular light show may be chosen based on design preferences/needs. Preferably, however, one red LED, one green LED, and one blue LED are used to achieve a wide range of possible perceived colors, as can be seen by the significant area bounded by the coordinates corresponding to such color LEDs shown in FIG. 1.

Within such an area, through extensive testing, we have invented and defined preferred, novel color shows. A first of such preferred color shows is an Autumn Sunset color show, an example of which is shown in FIG. 2, and discussed above in detail. The novel Autumn Sunset light show according to our invention can be defined as a light show which emits colored lights falling within an area of the CIE chart defined substantially by coordinates (0.15, 0.10), (0.12, 0.19), (0.85, 0.42), and (0.65, 0.35). In other words, those coordinates form the corner points of a box substantially bounding the preferred range of colors. As would be understood by one of ordinary skill in the art, any one of a number of colored LEDs can be combined to achieve a light show falling within this area.

Preferably, three different color LEDs are employed to display the show; however, two or more LEDs may be used to achieve this show. Of course, when only two LEDs are used, the light show will only be able to produce colors falling on a straight line connecting the two coordinates on the CIE chart corresponding to the wavelength emissions of the those two LEDs.

Another novel light show according to our invention is a "Winter Solstice" light show, an example of which is shown in FIG. 3, and discussed above in detail. The novel "Winter Solstice" light show according to our invention can be defined as a light show which emits colored lights falling within an area of the CIE chart defined substantially by coordinates (0.15, 0.02), (0.10, 0.10), (0.13, 0.02), (0.24, 0.31), and (0.34, 0.16). Again, any one of a number of colored LEDs can be combined to achieve a light show falling within this area. Preferably, three different color LEDs are employed to display the show.

Yet another novel light show according to our invention is a "Tuscany" light show, an example of which is shown in FIG. 4, and discussed above in detail. The novel "Tuscany" light show according to our invention can be defined as a light show which emits colored lights falling within an area of the CIE chart defined substantially by coordinates (0.58, 0.42), (0.70, 0.30), (0.60, 0.30), and (0.56, 0.40). Again, any one of a number of colored LEDs can be combined to achieve a light show falling within this area. Preferably, three different color LEDs are employed to display the show.

In addition, for each of the above-discussed novel light shows, it is preferred that the average ramp speeds not exceed approximately 10% per second. With the thus-defined novel light shows and preferred ramps speeds, a light object according to our invention can be controlled to emit a unique light show that is pleasing to a user and soothing and relaxing in its color changing.

It is also preferred that, within each thus-defined area, the light show be defined by a number of color points, with the rate of change from point to point being controlled by the ramp speed(s). Preferably, those color points define a path within the indicated area of the CIE chart that is at least one of straight, curved, sinuous, looped, figure-eight shaped, etc., or some combination thereof. Again, CIE coordinates are just one way of defining the light show. The coordinates themselves correspond to particular LEDs operating on their own or in combination with other LEDs at specific intensity levels. The light shows may also be defined in terms of the LEDs and their various intensity levels.

With these novel color shows, a light object according to our invention can provide a wash of colored lights that is soothing and rhythmic in nature.

Programming

Our invention is directed not only to methods of creating and defining a light show using the above processes, but the thus-defined light shows themselves, the programs embodying the light shows, the storage of light shows in a memory in the manners defined, the memory devices storing this information, and light objects which operate to display the defined and stored light shows.

Figure 6:
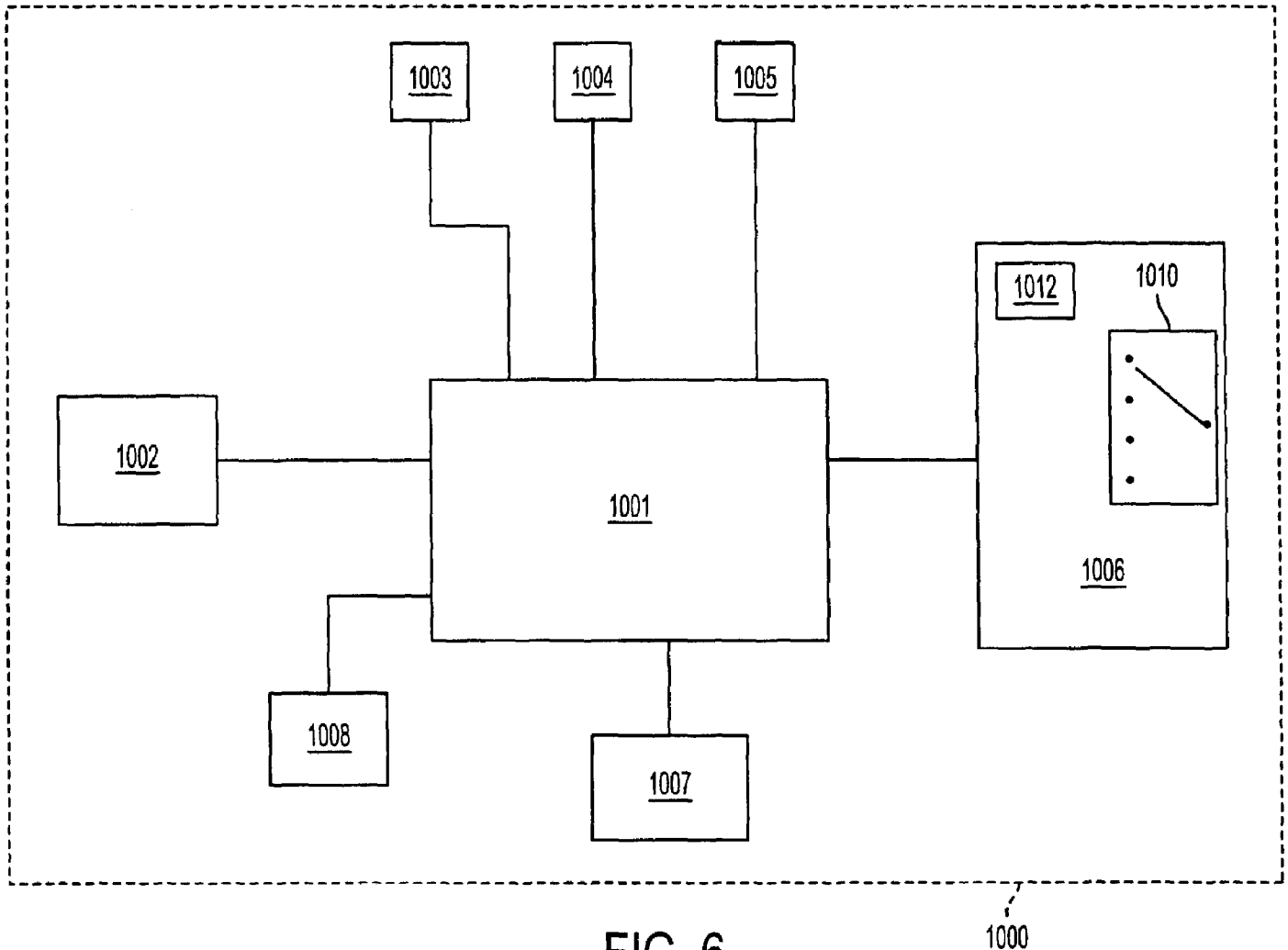
FIG. 6 is a schematic drawing of a light object having a control mechanism, according to one embodiment of our invention.

In that regard, we note that the light shows may be stored in permanent memories in light objects displaying the light shows. The memories may be provided in connection with microcontrollers operating to control a plurality of LEDs to achieve our light show invention. FIG. 6 is a schematic drawing of one such system, which includes a light object 1000, a microcontroller 1001, a memory 1002 (which may be external in the form of a memory card or internal, such as a memory chip, as shown in FIG. 6), a plurality of LEDs (1003 (red), 1004 (green), and 1005 (blue)), a user interface 1006, a power source 1007, and a clock mechanism 1008.

The light object 1000 may take any one of a number of forms. Preferably the light object is an artistic form, the boundaries of which transmit and/or reflect light, so that the color show may be emitted from within the light object 1000. In other embodiments, the light object 1000 may serve to project the light show on an external surface. Any one of a number of other forms may also be used.

Microcontroller 1001 may be an Amtel Mega8 processor. Memory 1002 preferably is Microchip 24LC00 (manufactured by Microchip Technologies, of Chandler, Ariz.) or an Amtel AT25F512 (manufactured by Amtel Corp., of San Jose, Calif.), or Dallas Semiconductor DS5206-UNW (manufactured by Maxim Integrated Products, Inc., of Sunnyvale, Calif.). In other embodiments the memory 1002 may be a memory chip or card detachable from the light object and microcontroller, so that the light shows stored therein may be removed and replaced with other memory cards/chips 1002. In this manner, the observer can purchase new memories 1002 over time, to continually update the light object with new and different light shows.

Preferably, the memory 1002 will store data concerning the light show, as discussed above. This data may include starting color points, ending color points, duration information for segments/shows, ramps speeds, other timing information, and the like. The microcontroller 1001 may have onboard program memory or external program memory containing the instructions for interpreting the light show data, calculating intervening light points, and controlling the LEDs based at least in part on the color data and timing information. Thus structured, memory 1002 storing the light shows does not need the full range of data typically provided in look-up tables used to define light shows.

The size of the memory 1002 and extent of the program stored therein to instruct the microcontroller 1001, and the extent of the program stored onboard the microcontroller 1001 in the manufacturing process can be determined based on design needs. Also, in future replacement memory cards, where such are used, additional logic can be provided to control the microcontroller 1001, when additional information is needed to operate the new light shows. One of ordinary skill in the art would appreciate the different ways of dividing up such information between the memory 1002 and microcontroller 1001. However, in a preferred embodiment, the system is defined such that microcontroller 1001 contains the operating instructions for the light shows and the memory 1002 contains the operating instructions for the light shows, including the timing, intensity, and ramp speed data for each LED used in the light shows.

When multiple light shows are provided in one memory 1002, it is preferable that the light object in which the memory 1002 is mounted be provided with a user interface 1006 to allow the user to switch between shows. In this embodiment, user interface 1006 includes a switch 1010 which allows a user to switch between different settings. The different settings may be on/off states and/or different light shows. In addition, a button 1012 may be provided to freeze a light show at a specified color point.

Numerous other user interfaces 1006 may be provided, as would be understood by one of ordinary skill in the art. For instance, a remote control (wireless or wired) may be provided to control the light object 1000 from a remote location. Because the programming and mechanics of remotes and other possible user interfaces are known in the art, a more detailed description will not be provided herein.

Additionally, a portion of the program memory containing the light show data onboard the microcontroller 1001 may be reprogrammed with new light show data via a standard personal computer through a serial or USB interface. The user interface 1006 may also consist of a conductive coating that responds to the user's touch, a rotary switch, a push button switch, or a mechanical switch that is actuated by pressing on the entire light object 1000. The user interface may also include a dial that indicates the color that the LEDs should be set to for a solid color of any hue. This dial may be labeled with a rainbow that allows the user to select the color that pleases them at any time, in which case the dial setting will control the microcontroller 1001 to program the relative intensities of LEDs 1003-1005.

INDUSTRIAL APPLICABILITY

Our invention provides novel light shows as well as methods of designing and storing light shows for use in a light object. Light shows according to our invention provide entertainment and decoration and are aesthetically pleasing. Moreover, our methods of designing and storing lights shows aid in the cost-effective production of light objects for consumers.

We claim:

1. A lighting object for providing a plurality of light shows to an observer, comprising:

at least three LEDs, including red, green and blue LEDs;

a microcontroller;

the LEDs being linked to the microcontroller by circuitry;

the microcontroller being programmed to independently control the intensity levels of each of the LEDs to vary colors perceived by the observer during the plurality of light shows;

a memory linked to the microcontroller, the plurality of light shows being stored in the memory, the plurality of light shows each comprising starting and target points corresponding to starting and target intensity levels for each of the LEDs with a segment extending continuously between the starting and target points and timing information for a duration of the segment to present a continuous change in color during the segment, each starting and target points and each segment extending therebetween falling within an area of a CIE 1931 Color Diagram defined by the following sets of coordinates (0.70, 0.30), (0.19, 0.72), (0.14, 0.06);

a user interface linked to the microcontroller, the user interface comprising at least one switch for switching the operation of the microcontroller between a plurality of settings selected from the group consisting of power on, power off, freezing a light show in progress and switching from one of the plurality of light shows to another of the plurality of light shows; and the microcontroller being programmed to calculate a plurality of intermediate intensity levels for each of the LEDs for the duration of the segment based on the starting and target intensity levels and the timing information for each of the LEDs, and the microcontroller being programmed to control each of the LEDs to operate at each of the calculated intermediate intensity levels during the segment.

2. The lighting object according to claim 1, wherein the microcontroller is programmed to control the intensity levels of the three LEDs so that each segment falls within an area of the CIE 1931 Color Diagram defined by at least one of the following sets of coordinates: (i) (0.15, 0.10), (0.12, 0.19), (0.85, 0.42) and (0.65, 0.35), (ii) (0.15, 0.02), (0.10, 0.10), (0.13, 0.02), (0.24, 0.31), and (0.34, 0.16), and (iii) (0.58, 0.42), (0.70, 0.30), (0.60, 0.30) and (0.56, 0.40).

3. The lighting object according to claim 1, wherein at least one of the plurality of light shows stored in the memory further comprising ramp data indicating a rate of change of the intermediate intensity levels for each of the LEDs in moving toward each of the target intensity levels.

4. The lighting object according to claim 3, wherein the microcontroller is programmed to limit the ramp data changes during the segment for at least one of the LEDs.

5. The lighting object according to claim 4, wherein the microcontroller uses pulse width modulation to control the intensity levels of the LEDs.

6. The lighting object according to claim 4, wherein the light show comprises a plurality of segments.

7. The lighting object according to claim 4 wherein the duration of each segment is at least about 9 seconds.

8. A lighting object for providing a plurality of light shows to an observer, comprising:

at least three LEDs, each of which emits light of a different wavelength;

a microcontroller;

the at least three LEDs being linked to the microcontroller by circuitry, the microcontroller being programmed to control intensity levels of the LEDs to vary colors perceived by the observer during the plurality of light shows;

a memory linked to the microcontroller;

each of the plurality of light shows is defined by stored data indicative of the intensity levels for each of the LEDs at starting points and target points, the microcontroller being programmed to calculate intermediated intensity levels of the LEDs indicated by the stored data such that the colors perceived by an observer in viewing the each of the plurality of light shows as each of the plurality of light shows proceeds from the starting point to the target point, which perceived colors are dictated by a combination of emissions from each of the LEDs, exist within an area of CIE 1931 Color Diagram defined by at least one of the following sets of coordinates: (i) (0.15, 0.10), (0.12, 0.19), (0.85, 0.42) and (0.65, 0.35); (ii) (0.15, 0.02), (0.10, 0.10), (0.13, 0.02), (0.24, 0.31), and (0.34, 0.16); and (iii) (0.58, 0.42), (0.70, 0.30), (0.60, 0.30) and (0.56, 0.40); and a user interface linked to the microcontroller, the user interface comprising at least one switch for switching the operation of the microcontroller between a plurality of settings selected from the group consisting of power on, power off, freezing a light show in progress and switching from one of the plurality of light shows to another of the plurality of light shows.

9. The lighting object according to claim 8, wherein the microcontroller is programmed to control the LEDs to limit the area of the CIE 1931 Color Diagram so that said area is defined by (0.15, 0.10), (0.12, 0.19), (0.85, 0.42) and (0.65, 0.35).

10. A method of controlling lighting object to provide a light show to an observer, comprising the steps of:

providing at least two LEDs, each of which emits light of a different wavelength;

independently controlling the intensity levels of the LEDs to vary colors perceived by the observer during the light show;

reading from a memory, for each of the LEDs, a starting intensity level at a starting point and a target intensity level at a target point and timing information for at least one segment of the light show between the starting and target points;

calculating a plurality of intermediate intensity levels for each of the LEDs for the duration of the segment based on the starting and target intensity levels, and the timing information for each of the LEDs; and controlling the LEDs to operate at each of the calculated intermediate intensity levels during the segment.

11. The method according to claim 10, wherein the timing information comprises ramp data indicating a rate of change of the intermediate intensity levels of each of the LEDs in moving toward each of the target intensity levels.

12. The method according to claim 11, wherein the ramp data changes during the segment for at least one of the LEDs.

13. The method according to claim 12, wherein the controlling step uses pulse width modulation to control the intensity levels of the LEDs.

14. The method according to claim 12, wherein the light show comprises a plurality of segments.

15. The method according to claim 12, wherein the providing step provides three LEDs, each of which emits light of a different wavelength.

16. The method according to claim 15, wherein the controlling step controls the intensity levels of the three LEDs so that the segment falls within an area of CIE 1931 Color Diagram defined by at least one of the following sets of coordinates: (i) (0.15, 0.10), (0.12, 0.19), (0.85, 0.42) and (0.65, 0.35), (ii) (0.15, 0.02), (0.10, 0.10), (0.13, 0.02), (0.24, 0.31), and (0.34, 0.16), and (iii) (0.58, 0.42), (0.70, 0.30), (0.60, 0.30) and (0.56, 0.40).

* * * * *